US010910726B2

(12) United States Patent
Chang et al.

(10) Patent No.: US 10,910,726 B2
(45) Date of Patent: Feb. 2, 2021

(54) SLOT ANTENNA AND TERMINAL

(71) Applicant: HUAWEI TECHNOLOGIES CO., LTD., Shenzhen (CN)

(72) Inventors: Chih-Hua Chang, Taipei (TW); Chien-Ming Lee, Shanghai (CN); Hanyang Wang, Reading (GB); Yen-Cheng Lai, Taipei (TW); Yu Chan Yang, Taipei (TW)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 16/065,813

(22) PCT Filed: Dec. 24, 2015

(86) PCT No.: PCT/CN2015/098689
§ 371 (c)(1),
(2) Date: Jun. 24, 2018

(87) PCT Pub. No.: WO2017/107137
PCT Pub. Date: Jun. 29, 2017

(65) Prior Publication Data

US 2019/0013588 A1 Jan. 10, 2019

(51) Int. Cl.

| | |
|---|---|
| ***H01Q 13/10*** | (2006.01) |
| ***H01Q 13/08*** | (2006.01) |
| ***H01Q 1/48*** | (2006.01) |
| ***H01Q 5/35*** | (2015.01) |
| ***H01Q 21/28*** | (2006.01) |
| ***H01Q 5/335*** | (2015.01) |

(Continued)

(52) U.S. Cl.
CPC ..... *H01Q 13/08* (2013.01); *H01Q 1/243* (2013.01); *H01Q 1/48* (2013.01); *H01Q 5/328* (2015.01); *H01Q 5/335* (2015.01); *H01Q 5/35* (2015.01); *H01Q 13/103* (2013.01); *H01Q 13/106* (2013.01); *H01Q 21/28* (2013.01)

(58) Field of Classification Search
CPC ..... H01Q 13/10; H01Q 1/243; H01Q 1/48; H01Q 5/328; H01Q 5/335
See application file for complete search history.

(56) References Cited

U.S. PATENT DOCUMENTS

| | | | | |
|---|---|---|---|---|
| 6,677,909 | B2 | 1/2004 | Sun et al. | |
| 6,864,848 | B2 * | 3/2005 | Sievenpiper | H01Q 9/14 343/767 |
| 9,379,445 | B2 * | 6/2016 | Zhu | H01Q 13/10 |

(Continued)

FOREIGN PATENT DOCUMENTS

| | | | |
|---|---|---|---|
| CN | 101320843 | A | 12/2008 |
| CN | 102130379 | A | 7/2011 |

(Continued)

*Primary Examiner* — Hasan Z Islam
(74) *Attorney, Agent, or Firm* — Kilpatrick Townsend & Stockton LLP

(57) ABSTRACT

This application discloses a slot antenna and a terminal. The slot antenna includes a ground plane, an open slot disposed on the ground plane, a slot feeder, and a resonant circuit. The resonant circuit effectively excites a current on a surface of the ground plane, so that the ground plane becomes a primary radiator, and the antenna is a secondary radiator. Therefore, a volume of the antenna can be reduced without affecting radiation efficiency of the antenna.

5 Claims, 10 Drawing Sheets

(51) Int. Cl.
*H01Q 5/328* (2015.01)
*H01Q 1/24* (2006.01)

(56) References Cited

U.S. PATENT DOCUMENTS

| | | | | |
|---|---|---|---|---|
| 9,502,773 | B2 * | 11/2016 | Tsai | H01Q 21/28 |
| 9,876,269 | B2 * | 1/2018 | Boire | H01Q 5/335 |
| 2008/0001836 | A1 * | 1/2008 | Guthrie | H01Q 13/10 343/767 |
| 2009/0066596 | A1 | 3/2009 | Fujishima et al. | |
| 2009/0256757 | A1 * | 10/2009 | Chiang | H01Q 1/2266 343/702 |
| 2010/0238079 | A1 | 9/2010 | Ayatollahi et al. | |
| 2011/0187615 | A1 * | 8/2011 | Sakata | H01Q 1/521 343/722 |
| 2011/0241498 | A1 | 10/2011 | Vedy | |
| 2011/0241948 | A1 | 10/2011 | Bevelacoua Peter et al. | |
| 2012/0119963 | A1 | 5/2012 | Soekawa | |
| 2014/0062815 | A1 | 3/2014 | Tsai et al. | |
| 2014/0062818 | A1 | 3/2014 | Tsai et al. | |
| 2015/0097745 | A1 | 4/2015 | Chou et al. | |

FOREIGN PATENT DOCUMENTS

| | | | |
|---|---|---|---|
| CN | 102570012 | A | 7/2012 |
| CN | 103545602 | A | 1/2014 |
| CN | 103682572 | A | 3/2014 |
| CN | 103682587 | A | 3/2014 |
| EP | 2704253 | A1 | 3/2014 |
| TW | 201036254 | A | 10/2010 |
| TW | 201238145 | A | 9/2012 |
| TW | I466382 | B | 12/2014 |
| WO | 2004102744 | A1 | 11/2004 |

* cited by examiner

SLOT ANTENNA AND TERMINAL

CROSS-REFERENCE TO RELATED APPLICATIONS

This application is a national stage of International Application No. PCT/CN2015/098689, filed on Dec. 24, 2015 which is hereby incorporated by reference in its entirety.

TECHNICAL FIELD

The present invention relates to the communications field, and in particular, to a slot antenna and a terminal.

BACKGROUND

Currently, using a large quantity of metal materials as appearance design elements of an electronic device becomes a tendency. However, radiation efficiency of an antenna in the electronic device is reduced because of the large quantity of metal materials. A research indicates that, compared with another antenna, a slot antenna can better resist impact of a metal material around the antenna.

However, a conventional slot antenna, especially a slot antenna working in a low frequency band, is oversized, and is not applicable to an electronic device (for example, a mobile phone) of a limited volume. Therefore, how to reduce a size of the slot antenna without reducing radiation efficiency becomes a problem that needs to be urgently resolved at present.

SUMMARY

This application provides a slot antenna and a terminal, so as to resolve a problem about how to reduce a size of a slot antenna without reducing radiation efficiency.

To achieve the foregoing objective, this application provides the following technical solutions:

A first aspect of this application provides a slot antenna, including a ground plane, an open slot disposed on the ground plane, a slot feeder, and a resonant circuit, where the slot feeder stretches across the slot, one end is connected to the ground plane, and the other end is connected to the resonant circuit; and the slot antenna is configured to work in a first resonant frequency, a length of the slot antenna does not exceed one fifth of a wavelength of the first resonant frequency, and a width of the slot antenna does not exceed 50% of the length of the slot antenna.

According to the slot antenna provided in this application, a current on a ground plane is enhanced based on a length of an open slot and a connection relationship among the open slot, a slot feeder, and a resonant circuit, so that a radiation body changes from an antenna body to a ground plane. Therefore, radiation efficiency is not affected when a volume of the antenna body is reduced.

In an implementation of the first aspect, the ground plane includes a first length and a first width, where the first length is six to eight times of the length of the slot antenna, and the first width is less than the first length.

In an implementation of the first aspect, the resonant circuit includes a first capacitor and an inductor that are connected in series between the slot feeder and a radio frequency circuit. Further, the resonant circuit further includes a second capacitor connected in series between the radio frequency circuit and the inductor. Further, the resonant circuit further includes a third capacitor connected to a common end of the inductor and the second capacitor. The second capacitor and the third capacitor can increase an adjustment freedom degree of the resonant circuit.

In another implementation of the first aspect, the slot feeder includes two slot feeders, where either of the slot feeders stretches across the slot, one end is connected to the ground plane, and the other end is connected to the resonant circuit. In this case, the resonant circuit includes a first capacitor and an inductor that are connected in series between one slot feeder and the radio frequency circuit, and a second capacitor, where one end of the second capacitor is connected to a common end of the inductor and the radio frequency circuit, and the other end is connected to the other slot feeder.

Based on the foregoing two implementations, in another implementation of the first aspect, the slot antenna further includes a matching circuit, where the resonant circuit is connected to the radio frequency circuit by using the matching circuit; and the matching circuit includes an inductor connected in series between the radio frequency circuit and a signal feed-in end of the resonant circuit, and a capacitor, where one end of the capacitor is grounded, and the other end is connected to a common end of the inductor and the signal feed-in end of the resonant circuit. The matching circuit can improve an operating frequency band of the slot antenna.

In another implementation of the first aspect, the resonant circuit includes a first capacitor connected in series between the slot feeder and a radio frequency circuit, and a second capacitor, where one end of the second capacitor is connected to a common end of the first capacitor and the radio frequency circuit, and the other end is grounded. Further, the slot antenna further includes a matching circuit, where the resonant circuit is connected to the radio frequency circuit by using the matching circuit; and the matching circuit includes an inductor connected in series between the radio frequency circuit and a signal feed-in end of the resonant circuit.

Based on the foregoing implementations, in another implementation of the first aspect, values of the capacitor and the inductor in the resonant circuit are determined according to the first frequency band.

A second aspect of this application provides a terminal, including the slot antenna provided in the first aspect.

According to the slot antenna provided in the first aspect, an antenna volume may be reduced without affecting an antenna radiation effect. Therefore, the terminal provided in the third aspect may have a smaller volume.

In an implementation of the second aspect, the terminal includes two slot antennas, and the two slot antennas are disposed in different positions on a ground plane of the terminal. Each slot antenna is the slot antenna provided in the first aspect. According to the terminal, an antenna size may be reduced without reducing radiation efficiency, and further, there is relatively good isolation, thereby avoiding disposing an isolation component between the two slot antennas, and further reducing the antenna volume.

BRIEF DESCRIPTION OF DRAWINGS

To describe the technical solutions in the embodiments of the present invention or in the prior art more clearly, the following briefly describes the accompanying drawings required for describing the embodiments or the prior art. Apparently, the accompanying drawings in the following description show merely some embodiments of the present invention, and a person of ordinary skill in the art may still derive other drawings from these accompanying drawings without creative efforts.

DESCRIPTION OF EMBODIMENTS

Figure 1:
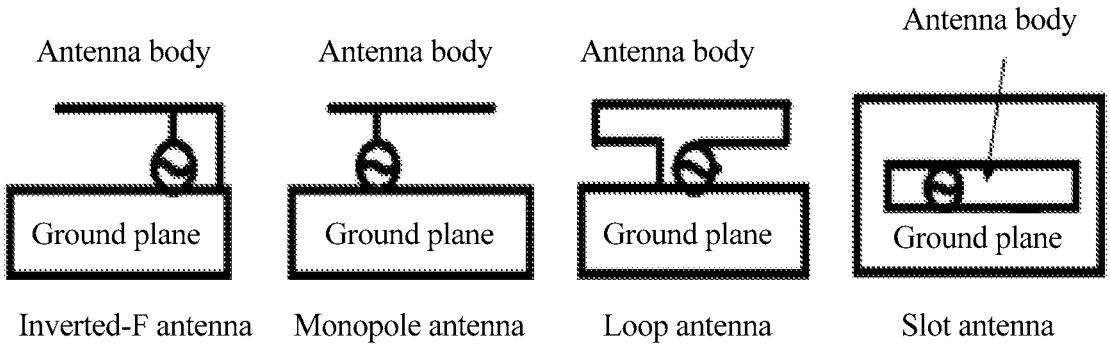
FIG. 1 (Prior Art)
FIG. 1 is a schematic diagram of an antenna in an electronic device that is divided into two parts: an antenna body and a ground plane.

As shown in FIG. 1, an antenna disposed in an electronic device may be divided into two parts: an antenna body and a ground plane. When being excited, the antenna may radiate energy by separately using the antenna body and the ground plane. During radiation, especially radiation in a frequency band greater than a high frequency 1.7 GHz, most energy of a conventional antenna, for example, an inverted-F antenna (IFA), a monopole (Monopole) antenna, a loop (Loop) antenna, or a slot (Slot) antenna, is radiated by an antenna body, and only little energy is radiated by a ground plane. That is, in this case, the antenna body dominates the antenna, and a size of the antenna body determines a frequency band range excited by the antenna.

According to an antenna structure disclosed in this embodiment of the present invention, a current on the ground plane of the antenna may be increased so that the ground plane dominates the radiation of the antenna, and only little energy is radiated by the antenna body. In this case, a volume of the antenna body may be reduced without affecting radiation efficiency of the antenna.

Figure 2A:
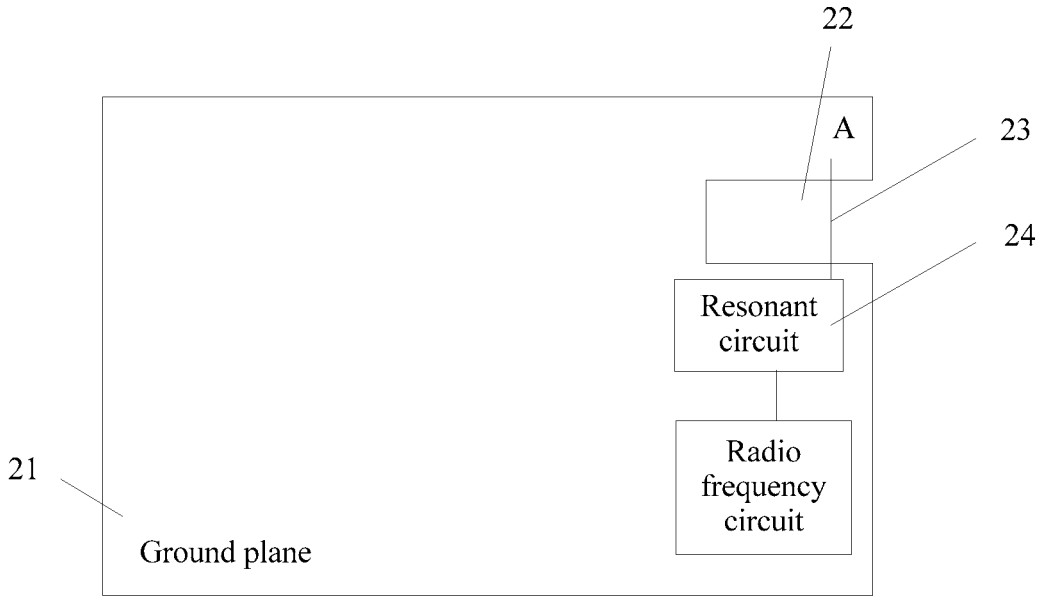
FIG. 2*a* is a top view of a structure of a slot antenna according to an embodiment of the present invention.

FIG. 2*a* (a medium layer of a circuit board is not drawn) is a top view of a structure of a slot antenna according to an embodiment of the present invention.

FIG. 2*a* includes a ground plane 21, an open slot 22 disposed on the ground plane, a slot feeder 23, and a resonant circuit 24. The slot feeder 23 stretches across the slot 22, one end is connected to the ground plane 21 by using a pint A, and the other end is connected to the resonant circuit 24.

The resonant circuit 24 is configured to excite a current on a surface of the ground plane, so that the ground plane becomes a primary radiator.

Figure 2B:
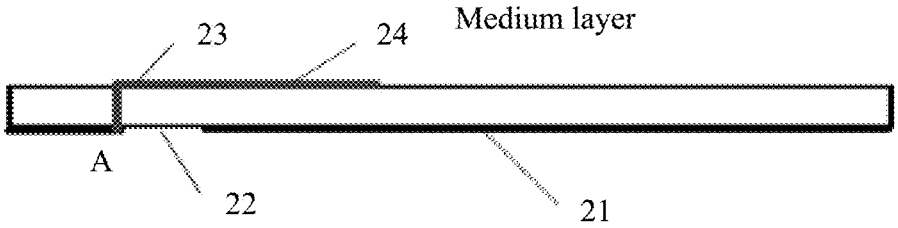
FIG. 2*b* is a side view of a structure of the slot antenna shown in FIG. 2*a;*

FIG. 2*b* shows a right view of the slot antenna shown in FIG. 2*a*. The ground plane 21 is deployed on a lower surface of the medium layer of the circuit board. The open slot 22 is disposed on the ground plane 21. It should be noted that no open slot is disposed on the medium layer. The slot feeder 23 passes through the medium layer, stretches across the open slot 22 on an upper surface of the medium layer, and is connected to the resonant circuit 24 disposed on the upper surface of the medium layer.

The slot antenna shown in FIG. 2*a* and FIG. 2*b* is configured to work in a first resonant frequency. A length of the slot antenna does not exceed one fifth of a wavelength of the first resonant frequency, and a width of the slot antenna does not exceed 50% of the length of the slot antenna, so that the slot antenna has relatively good radiation performance. The ground plane includes a first length and a first width. Preferably, the first length is six to eight times of the length of the slot antenna, and the first width is less than the first length.

Figure 2C:
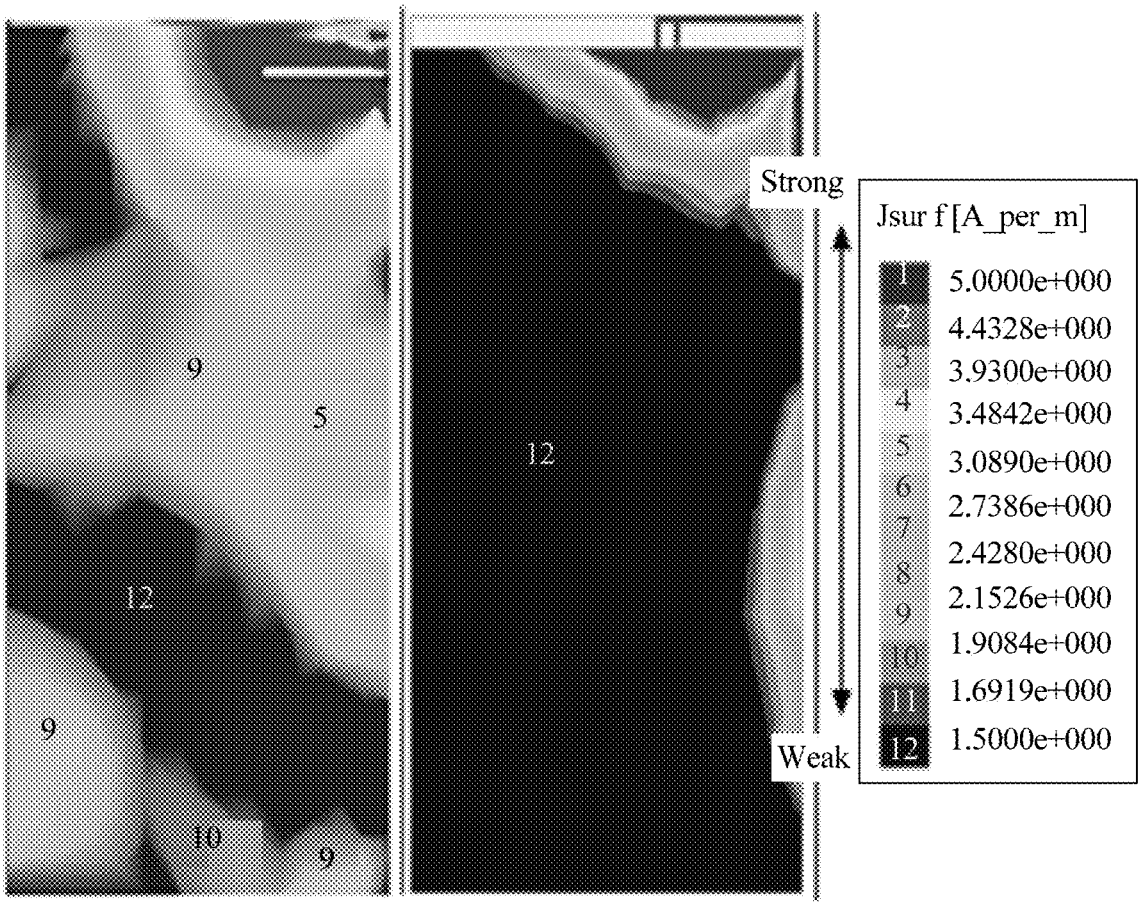
FIG. 2*c* is a schematic diagram of comparison between ground plane current distribution of the slot antenna shown in FIG. 2*a* or FIG. 2*b* and that of a conventional antenna.

A connection manner of the resonant circuit 24, the slot feeder 23, and the ground plane 21 shown in FIG. 2*a* and FIG. 2*b* is used to excite modality of the ground plane 21 in a first frequency band, so that there is a relatively strong current on the ground plane. As shown in FIG. 2*c*, simulation indicates that, when power of a feed-in signal source is 1 W, and the first resonant frequency is 2000 MHz, surface current density on almost a half of the ground plane of the slot antenna shown in FIG. 2*a* and FIG. 2*b* is greater than 2 A/m, and is apparently greater than current density on a ground plane of a conventional antenna.

An experiment indicates that an antenna size of the slot antenna shown in FIG. 2*a* or FIG. 2*b* may be reduced from an original 0.25 times of an operation wavelength to 0.10-0.14 times of the operation wavelength. Therefore, the antenna is suitable for being placed inside an electronic device such as a mobile phone.

Figure 3:
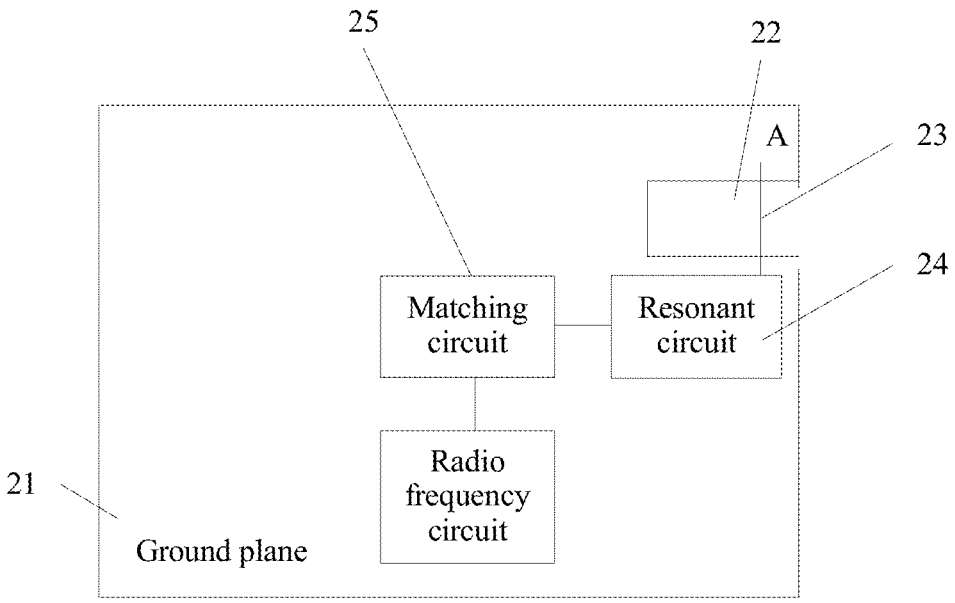
FIG. 3 is a schematic structural diagram of another slot antenna according to an embodiment of the present invention.

In some embodiments, the slot antenna shown in FIG. 2*a* may further include a matching circuit 25. As shown in FIG. 3, one end of the matching circuit 25 is connected to the resonant circuit 24, and the other end is connected to a radio frequency circuit. For a function of the radio frequency circuit, refer to technologies, and details are not described herein.

The matching circuit is used to increase a bandwidth of the slot antenna, so as to meet a coverage requirement of the electronic device for multiple frequency band bandwidths (for example, a bandwidth of 1800-2690 MHz).

In some embodiments, in the slot antenna shown in FIG. 2 and FIG. 3, the slot feeder 23 is close to an opening of the slot 22, for example, 2-5 millimeters away from the opening, so as to obtain better antenna efficiency. In some embodiments, a size of the open slot may be 20×2 $mm^2$.

In the slot antenna shown in FIG. 2 and FIG. 3, the current on the surface of the ground plane is effectively excited by using the resonant circuit, so that the ground plane becomes the primary radiator and the antenna is a secondary radiator. Therefore, the volume of the antenna may be reduced without affecting radiation efficiency of the antenna.

The following describes several specific circuit structures of the resonant circuit and the matching circuit in detail.

Figure 4:
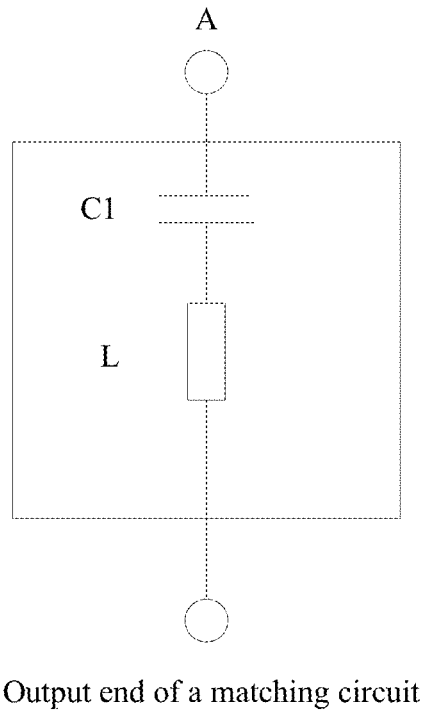
FIG. 4 is a schematic structural diagram of a resonant circuit in a slot antenna according to an embodiment of the present invention.

FIG. 4 is an example implementation of a resonant circuit, including a first capacitor C1 and an inductor L. The C1 and the L are connected in series between a slot feeder (that is, a ground point A) and an output end of a matching circuit.

Figure 5:
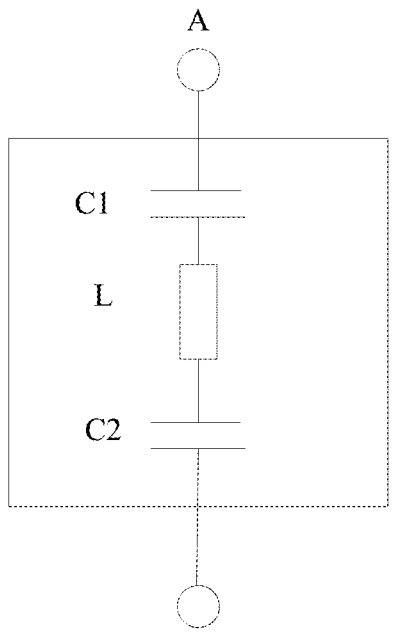
FIG. 5 is a schematic structural diagram of another resonant circuit in a slot antenna according to an embodiment of the present invention.

FIG. 5 is another example implementation of a resonant circuit, including a first capacitor C1, an inductor L, and a second capacitor C2. The C1, the L, and the C2 are connected in series between a slot feeder (that is, a ground point A) and an output end of a matching circuit. Compared with FIG. 4, the C2 added to FIG. 5 is used to increase a freedom degree of circuit debugging.

Figure 6:
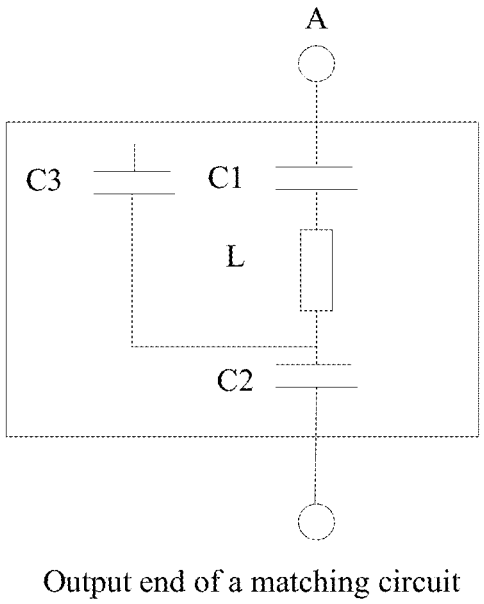
FIG. 6 is a schematic structural diagram of still another resonant circuit in a slot antenna according to an embodiment of the present invention.

FIG. 6 is another example implementation of a resonant circuit, including a first capacitor C1, an inductor L, a second capacitor C2, and a third capacitor C3. The C1, the L, and the C2 are connected in series between a slot feeder (that is, a ground point A) and an output end of a matching circuit, one end of the C3 is connected to a common end of the L and the C2, and the other end is open.

Figure 7:
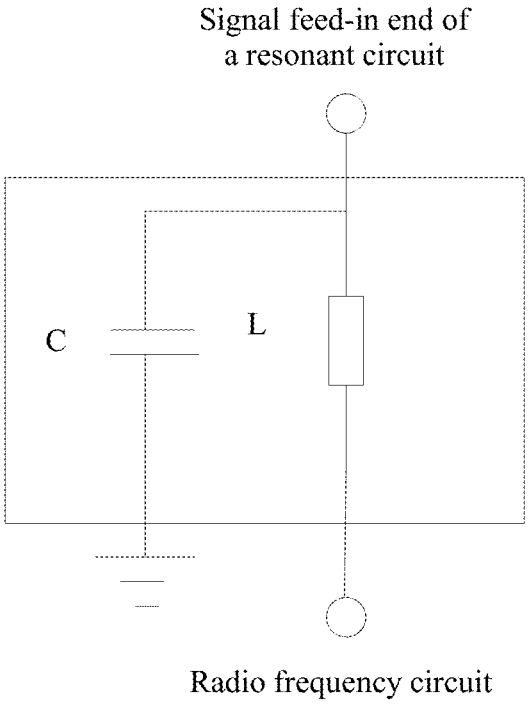
FIG. 7 is a schematic structural diagram of a matching circuit in a slot antenna according to an embodiment of the present invention.

FIG. 7 shows the matching circuit that matches the resonant circuit shown in FIG. 4, FIG. 5, or FIG. 6. The matching circuit includes an inductor L and a capacitor C. The L is connected in series between a radio frequency circuit and a signal feed-in end of the resonant circuit. One end of the C is grounded, and the other end is connected to a common end of the L and the signal feed-in end of the resonant circuit.

Figure 8:
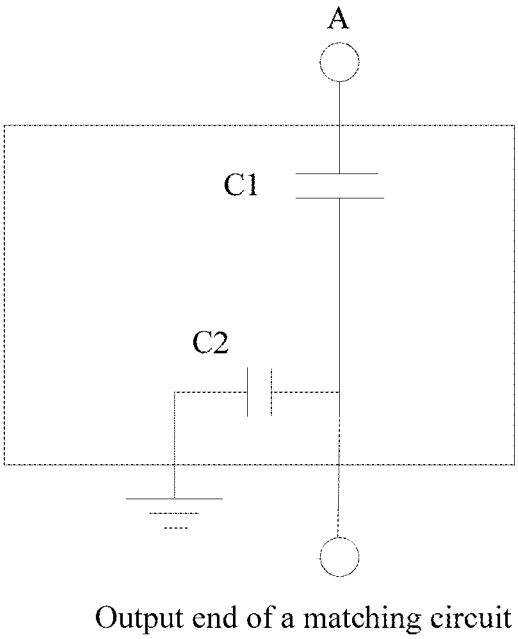
FIG. 8 is a schematic structural diagram of another resonant circuit in a slot antenna according to an embodiment of the present invention.

FIG. 8 is another example implementation of a resonant circuit, including a first capacitor C1 and a second capacitor C2. The C1 is connected in series between a slot feeder (that is, a ground point A) and an output end of a matching circuit. One end of the C2 is grounded, and the other end is connected to a common end of the C1 and the output end of the matching circuit.

Figure 9:
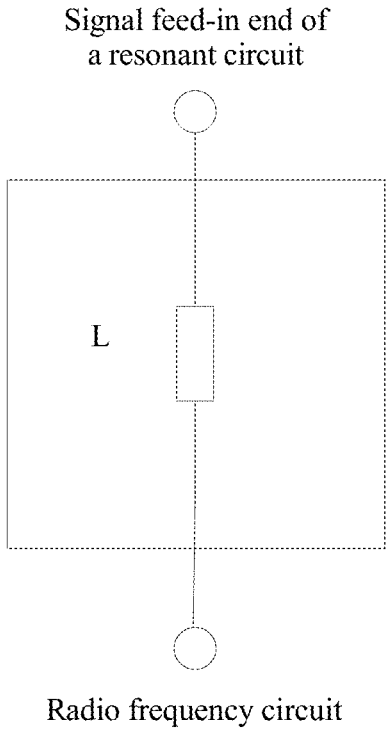
FIG. 9 is a schematic structural diagram of another matching circuit in a slot antenna according to an embodiment of the present invention.

FIG. 9 shows the matching circuit that matches the resonant circuit shown in FIG. 8. The matching circuit includes an inductor L connected in series between a radio frequency circuit and a signal feed-in end of the resonant circuit.

Figure 10:
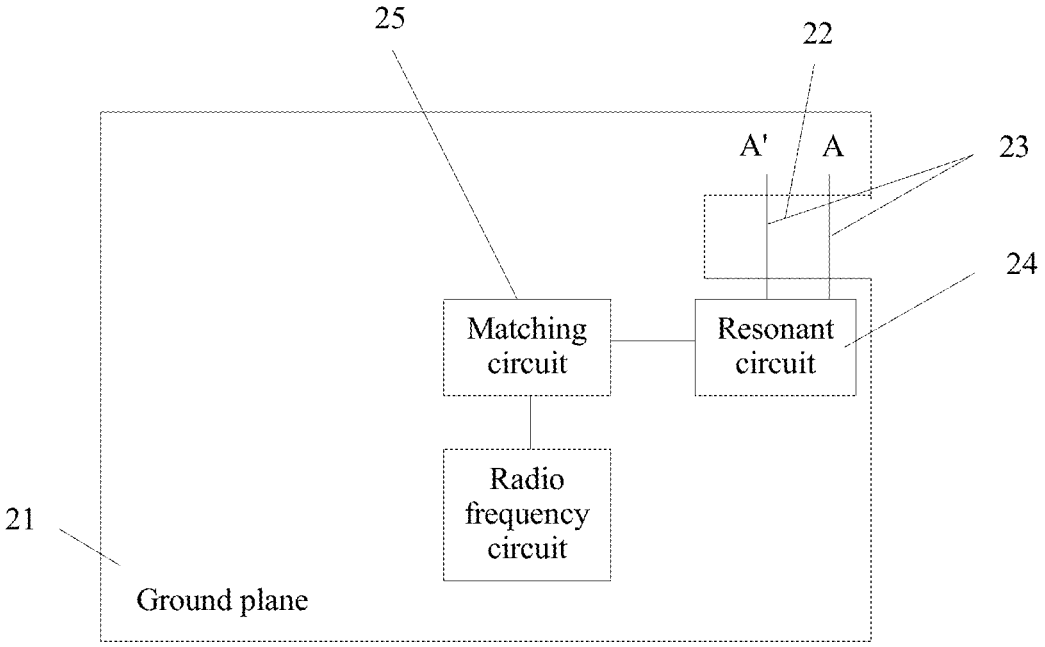
FIG. 10 is a schematic structural diagram of still another slot antenna according to an embodiment of the present invention.
Figure 11:
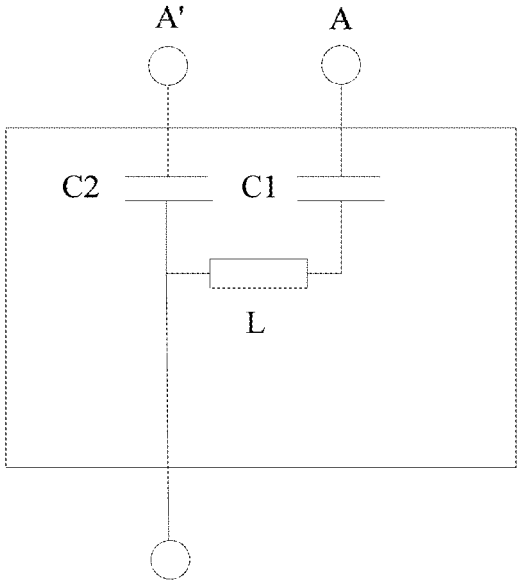
FIG. 11 is a schematic structural diagram of still another resonant circuit in a slot antenna according to an embodiment of the present invention.

The slot antenna shown in FIG. 2 and FIG. 3 may further include another slot feeder. As shown in FIG. 10, the slot antenna includes two slot feeders. In this case, FIG. 11 shows another example implementation of a resonant circuit, including a first capacitor C1, a second capacitor C2, and an inductor L. The C1 and the L are connected in series between one slot feeder (that is, a ground point A) and an output end of a matching circuit. One end of the C2 is connected to the other slot feeder (that is, a ground point A'), and the other end is connected to a common end of the L and the output end of the matching circuit.

For the matching circuit that matches FIG. 11, refer to FIG. 7.

Figure 12:
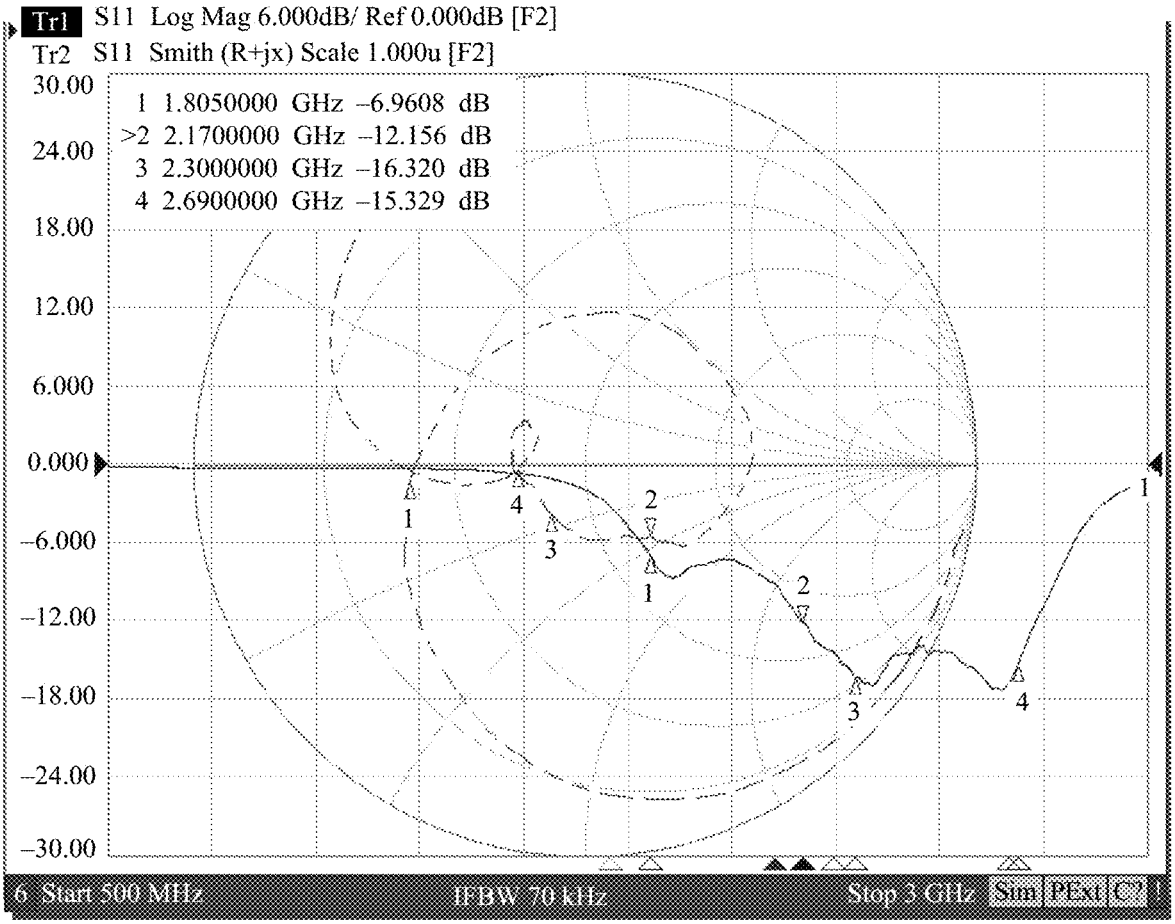
FIG. 12 is a schematic diagram of a measured return loss curve (solid line) and a Smith chart (dashed line) that are of a slot antenna according to an embodiment of the present invention.
Figure 13:
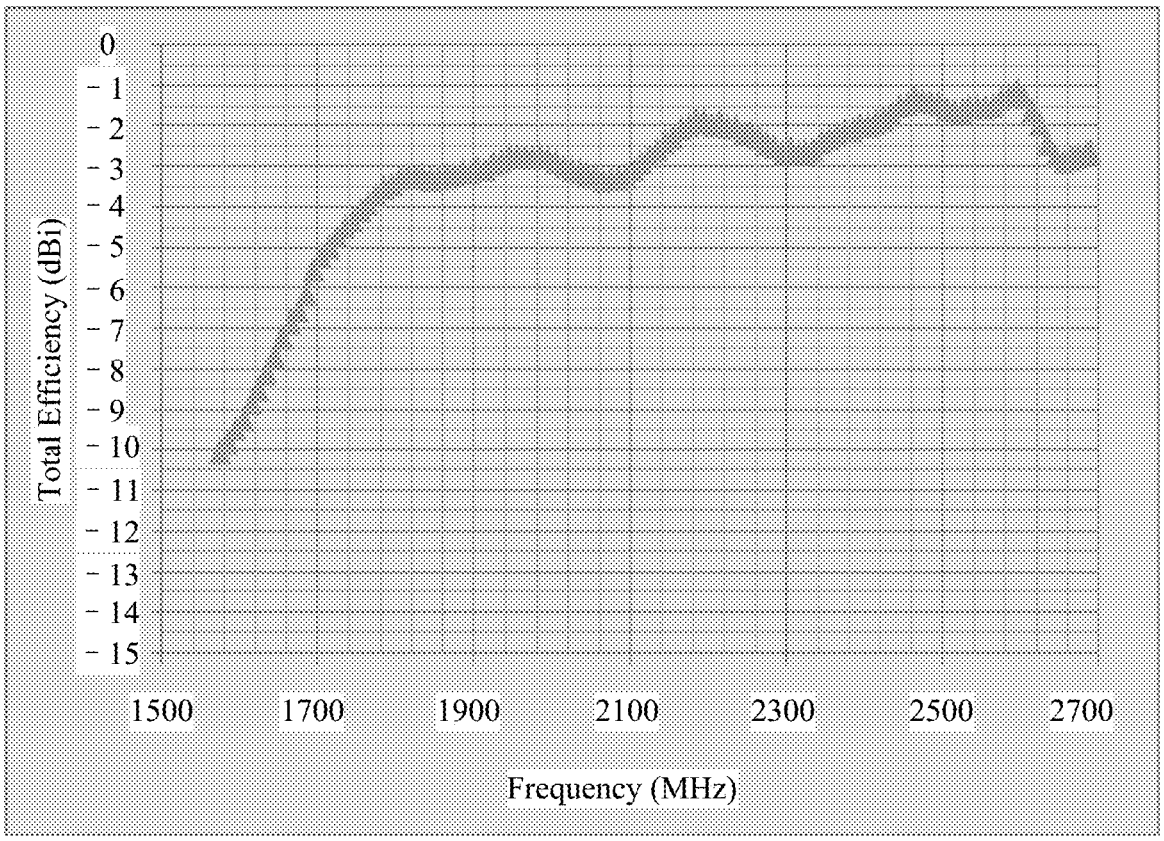
FIG. 13 is a diagram of measured radiation efficiency of a slot antenna according to an embodiment of the present invention.

FIG. 11 is used as an example, and it is assumed that C1=0.2 pF, C2=0.2 pF, and L=16 nH. FIG. 7 is used as an example, and it is assumed that C=0.3 pF and L=5.6 nH. A measured return loss curve (solid line) and a Smith chart (curve) that are of an antenna including a resonant circuit and a matching circuit that are formed by components of the foregoing values are shown in FIG. 12. An antenna bandwidth may substantially cover an application frequency band such as Band 1/2/3/7/39/40/41. If −6 dB is used for calculation, an impedance bandwidth of the antenna is approximately 1,250 MHz (1,600-2,850 MHz), which is approximately 56% when being converted into a bandwidth percentage. Referring to FIG. 13, FIG. 13 is a diagram of measured radiation efficiency of the antenna according to this embodiment. The efficiency is approximately −1.2 to −3.5 dB in a frequency band of 1,600-2,850 MHz. It may be learned from measured data that the radiation efficiency of the antenna meets an actual application requirement.

Figure 14:
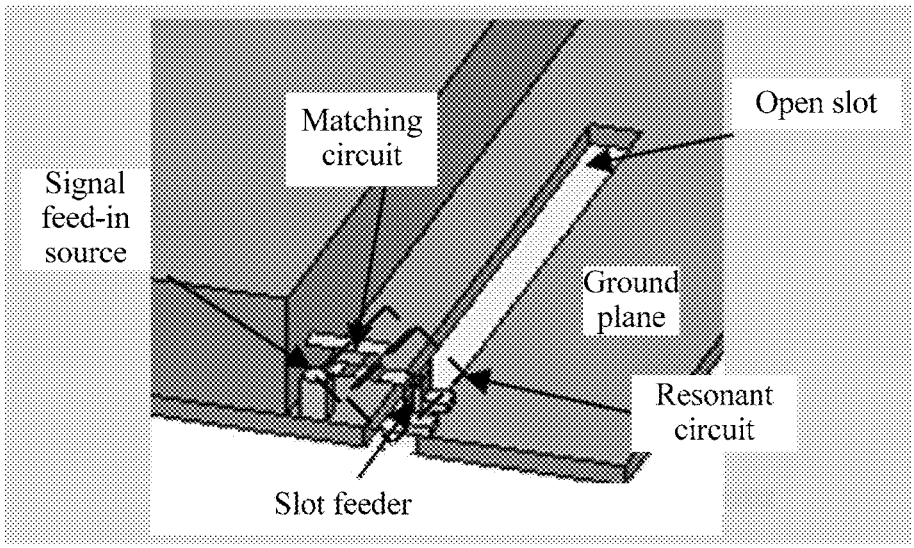
FIG. 14 is a schematic entity diagram of a slot antenna according to an embodiment of the present invention.

FIG. 14 is a schematic entity diagram (a medium layer of a circuit board is not drawn) of the slot antenna.

It should be noted that, in all the foregoing diagrams, an example in which the slot antenna includes both a resonant circuit and a matching circuit is used for description. If the matching circuit is not included, the "output end of a matching circuit" in the foregoing diagrams is the radio frequency circuit.

Figure 15:
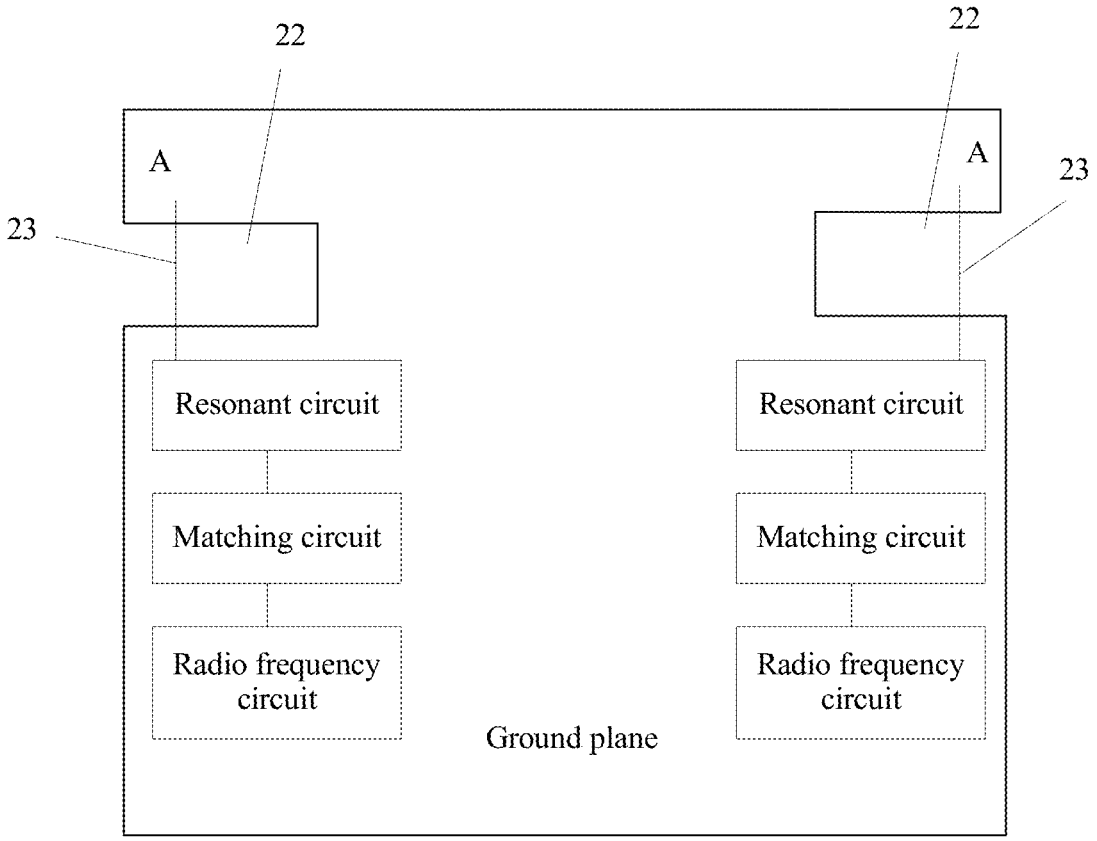
FIG. 15 is a dual-antenna system including a slot antenna according to an embodiment of the present invention.

A dual-antenna system may be constituted by using the foregoing slot antenna. The dual-antenna system may include two slot antennas shown in FIG. 2, FIG. 3, or FIG. 10. As shown in FIG. 15, the two slot antennas may share one ground plane. Resonant circuits of the two slot antennas may be integrated into one circuit, and matching circuits of the two slot antennas may also be integrated into one circuit.

According to the dual-antenna system shown in FIG. 15, an antenna size may be reduced without reducing radiation efficiency, and further, there is relatively good isolation, thereby avoiding disposing an isolation component between the two slot antennas, and further reducing the antenna volume.

The embodiments in this specification are all described in a progressive manner, for same or similar parts in the embodiments, reference may be made to these embodiments, and each embodiment focuses on a difference from other embodiments.

The embodiments disclosed above are described to enable a person skilled in the art to implement or use the present invention. Various modifications to the embodiments may be obvious to the person skilled in the art, and general principles defined in this disclosure may be implemented in other embodiments without departing from the spirit or scope of the present invention. Therefore, the present disclosure is not intended to be limited to these embodiments illustrated in the present disclosure, but shall be construed in the widest scope consistent with the principles and novel features disclosed in the present disclosure.

What is claimed is:

1. A slot antenna, comprising:

a ground plane, a rectangular shaped slot disposed on the ground plane and having an open end, a slot feeder, and a resonant circuit, wherein the slot feeder stretches across the rectangular shaped slot, wherein one end of the slot feeder is connected to the ground plane, and another end of the slot feeder is connected to the resonant circuit;

the slot antenna is configured to work in a resonant frequency band, wherein a length of the slot antenna does not exceed one fifth of a wavelength of the resonant frequency band, and a width of the slot antenna does not exceed 50% of the length of the slot antenna;

the resonant circuit is configured to excite a current on a surface of the ground plane, so that the ground plane becomes a primary radiator; and the slot feeder is 2-5 millimeters (mm) away from the open end of the rectangular shaped slot, wherein the resonant circuit comprises:

a first capacitor connected in series between the slot feeder and a radio frequency circuit, and a second capacitor, wherein one end of the second capacitor is connected to a common end of the first capacitor and the radio frequency circuit, and another end of the second capacitor is grounded;

wherein the resonant circuit is connected to the radio frequency circuit by a matching circuit, the matching circuit comprises an inductor connected in series between the radio frequency circuit and a signal feed-in end of the resonant circuit.

2. The slot antenna according to claim 1, wherein the slot feeder comprises: two slot feeders, wherein each of the two slot feeders stretches across the rectangular shaped slot, one end of the respective slot feeders is connected to the ground plane, and another end of the respective slot feeders is connected to the resonant circuit.

3. A terminal, comprising a slot antenna, wherein the slot antenna comprises:

a ground plane, a rectangular shaped slot disposed on the ground plane and having an open end, a slot feeder, and a resonant circuit, wherein the slot feeder stretches across the rectangular shaped slot, wherein one end of the slot feeder is connected to the ground plane, and another end of the slot feeder is connected to the resonant circuit;

the slot antenna is configured to work in a first resonant frequency band, a length of the slot antenna does not exceed one fifth of a wavelength of the first resonant frequency band, and a width of the slot antenna does not exceed 50% of the length of the slot antenna;

the resonant circuit is configured to excite a current on a surface of the ground plane, so that the ground plane becomes a primary radiator; and the slot feeder is 2-5 millimeters (mm) away from the open end of the rectangular shaped slot, wherein the resonant circuit comprises:

a first capacitor connected in series between the slot feeder and a radio frequency circuit, and a second capacitor, wherein one end of the second capacitor is connected to a common end of the first capacitor and the radio frequency circuit, and another end of the second capacitor is grounded;

wherein the resonant circuit is connected to the radio frequency circuit by a matching circuit, the matching circuit comprises an inductor connected in series between the radio frequency circuit and a signal feed-in end of the resonant circuit.

4. The terminal according to claim 3, wherein the terminal comprises two slot antennas having same structure.

5. The terminal according to claim 3, wherein values of the first and second capacitors in the resonant circuit are determined according to the resonant frequency band.

* * * * *